US005195898A

United States Patent [19]

Mary

[11] Patent Number: 5,195,898

[45] Date of Patent: Mar. 23, 1993

[54] NON-SHEARING CONNECTORS FOR FLEXIBLE CIRCUITS

[75] Inventor: Brian J. Mary, Bowie, Md.

[73] Assignee: The United States of America as represented by the Secretary of the Army, Washington, D.C.

[21] Appl. No.: 822,517

[22] Filed: Jan. 17, 1992

[51] Int. Cl.[5] ..... H01R 9/09

[52] U.S. Cl. ..... 439/77; 439/320; 439/499; 439/67; 439/329

[58] Field of Search ..... 439/67, 77, 320, 329, 439/339, 372, 492, 499, 868, 909

[56] References Cited

U.S. PATENT DOCUMENTS 4,526,432 7/1985 Cronin et al. ..... 439/320

5,064,377 11/1991 Wood ..... 439/77

*Primary Examiner*—Paula A. Bradley

*Attorney, Agent, or Firm*—Saul Elbaum; Muzio B. Roberto

[57] ABSTRACT

A non-shearing connector for a flexible circuit comprising a top retaining disc segment having an exterior threaded section suitably contoured to be compatible with the hollow section of an exterior threaded connector body segment. A pressure plate having integral captive stub means suitably designed to cooperate with slot means positioned on the underside of the retaining disc segment. A center stub protrudes from an insulated bottom segment of the connector body, and in conjunction with the captive stub form clamping means for a stripline, when the device is assembled.

3 Claims, 3 Drawing Sheets

NON-SHEARING CONNECTORS FOR FLEXIBLE CIRCUITS

RIGHTS OF THE GOVERNMENT

The invention described herein may be manufactured, used, and licensed by or for the Government for Governmental purposes without the payment to us of any royalties theron.

BACKGROUND OF INVENTION

1. Field of Invention

The invention relates to an electrical connector having utility in situations requiring high voltage and low inductance, as in the detonation of an explosive. An example is the interconnection through a bulkhead of a detonating cable having a small cross-section for an Exploding Foil Initiator (EFI). Discharging a high voltage, e.g., of about 2–10 KV, through a cable into an EFI in a near-instantaneous manner develops a large current pulse of about 4–10 K A through the detonator. This vaporizes the conductor propelling a thin film substrate on which the conductor is deposited into an explosive pellet positioned a short distance away, thereby initiating an explosion of the pellet.

2. Description of Related Art

To achieve the high currents and required rapid current resistance required in this type of system, a discharge circuit of low resistance and inductance is required. This circuit is typically a flat cable assembly with two conductors parallel to each other and separated by an insulating film. This cable is often connected to a Safe and Arm device via means known as a "Bullseye" connector. This connector maintains the hermeticity of the Safe and Arm device, while allowing the detonator cable to be detached for test and assembly.

The typical Bullseye connector has been used in Government weapons application for an number of years. The primary application has been nuclear weapons Safe and Arms and warhead firing systems. Therefore, there is little published data.

The prior art connector in use, i.e., Bullseye, is shown in FIG. 1. This system comprises a top section 10 having an internally threaded center 12 designed to be compatible with externally threaded center post 14 of bottom section 16. The threaded post positioned on bottom component 14 is also designed to be compatible with aperture 18 positioned on the stripline cable 20 shown in FIG. 2.

In operation, aperature 18 of a stripline cable having two copper conductors 19 parallel to each other, is positioned through post 14, and top section 10 is screwed into bottom section 16, so as to clamp the cable between the top and and bottom section.

The center post of this device is of a comparatively small cross section, whose narrow path increases the circuit's inductance. This can effect detonation performance in low-energy design. Another problem which can arise is that the stripeline conductor material can be torn or sheared by torquing the top section of the disc, which can tend to drag the conductor material, possibly wrinkling the stripline material. A further problem is the wide planar distance which must be allowed for insulation on the stripline cable. This is necessary to prevent arcing from one side of the cable through the post hole to the other side.

SUMMARY OF INVENTION

The present invention avoids the problems associated with the prior art device by eliminating the center post and threading the exterior of the retaining disc and interior of the connector body to make a union, thereby using the connector case as a circuit path. The case would typically be ground potential, thus also providing a connector shield. Also, a higher voltage is carried on a center stub of the connector body, in comparison with the prior art Bullseye post. This is because the center stub may be of a larger diameter due to the elimination of cable hole 18 and its planar insulating region. Further, damage to the plate is allowed to rotate with respect to the retaining disc, so that when the rotating disc is torqued down, it applies only downward pressure and not rotating shear to the cable. The elimination of the center post, and its corresponding planar insulating region also allows the stripline cable to be kept at a narrow width and still perform optimum electrical performance.

DESCRIPTION OF PREFERRED EMBODIMENT

Figure 1:
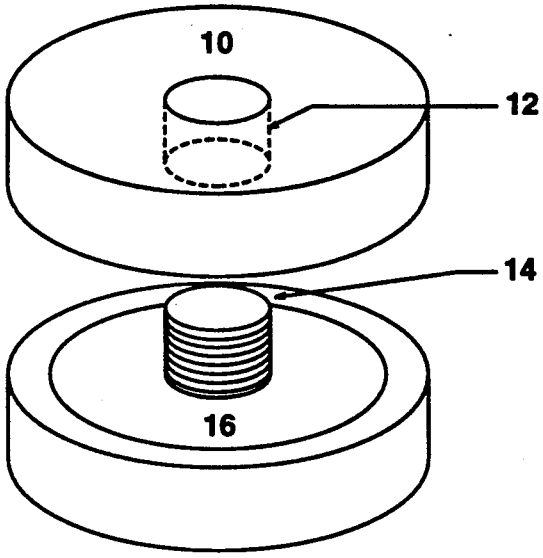
Fig 1 (Prior Art)
FIG. 1 is a perspective view of a prior art connector.
Figure 2:
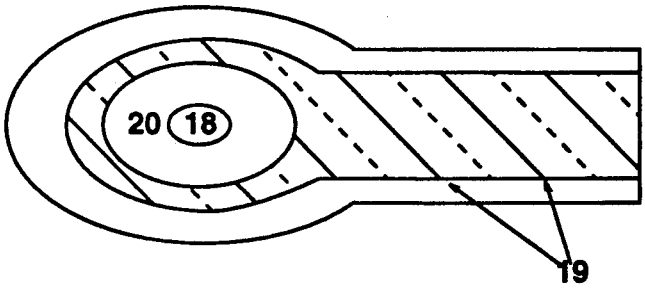
Fig 2 (Prior Art)
FIG. 2 is a plan view of a prior art stripeline cable.
Figure 3:
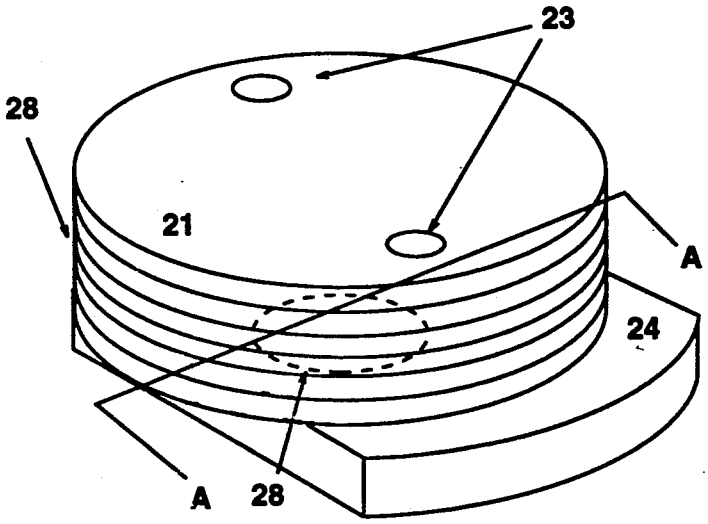
FIG. 3 is a perspective view of the retaining disc component of the present invention.
Figure 4:
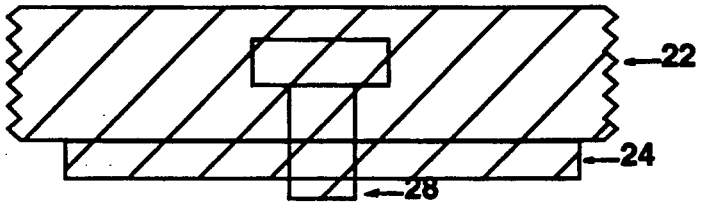
FIG. 4 is a horizontal view through A—A of FIG. 3.
Figure 5:
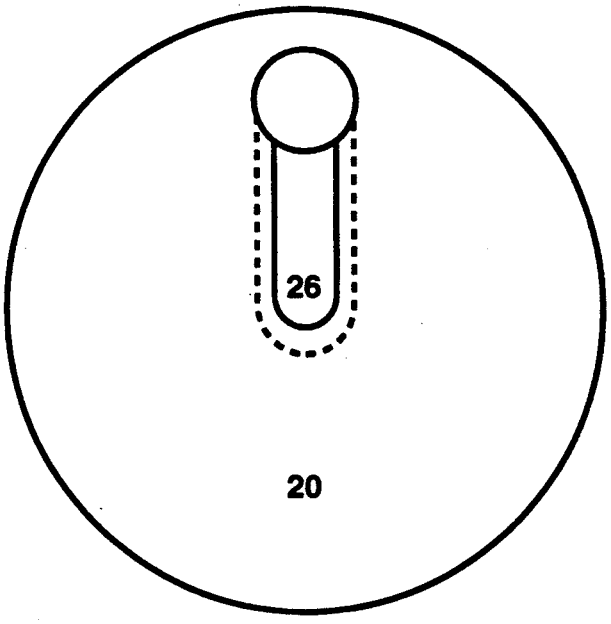
FIG. 5 is a plan view of slot means employed on the underside of retaining disc of FIG. 3.
Figure 6:
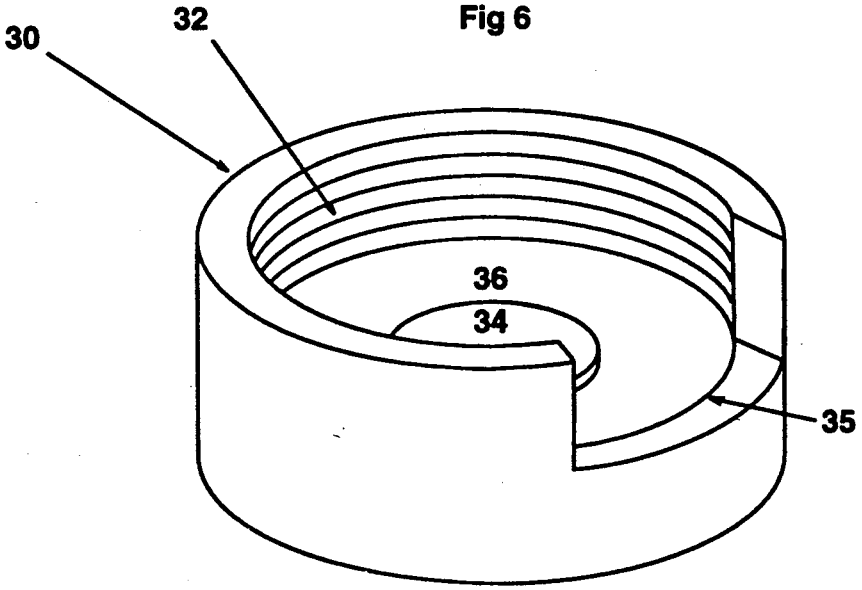
FIG. 6 is a perspective view of the connector body component.
Figure 7:
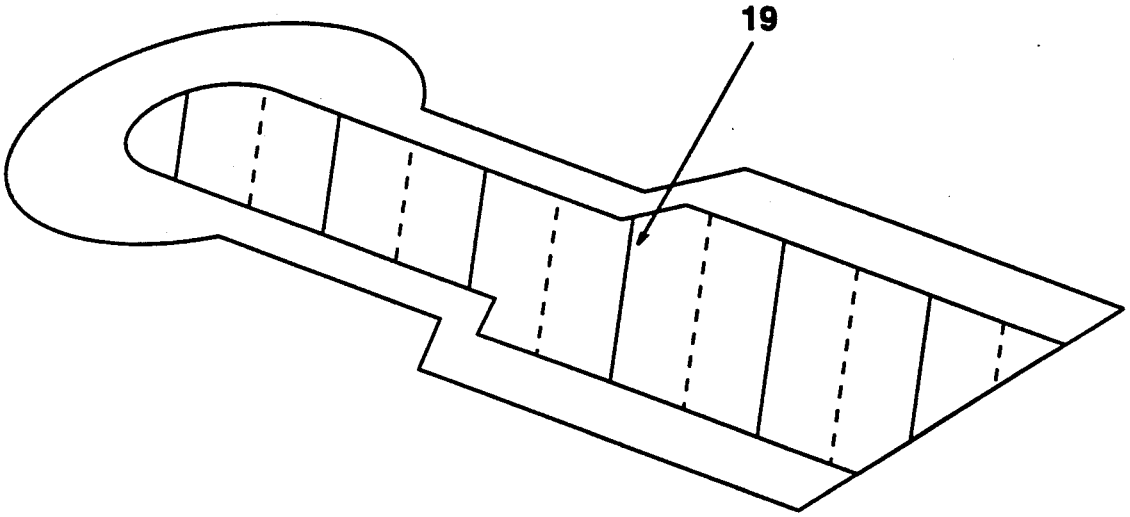
FIG. 7 is a plan view of the stripeline cable of the present invention.

Referring now to FIG. 3 of the drawings, the present invention comprises retaining disc 21 having external threaded segment 22, which is designed to be compatible with hollow interiorly threaded segment 32 of connector body 30. The retaining disc may contain a series of small holes 23 extending vertically partially therethrough from the top surface thereof as an aid in asembling the retaining disc and the connector body. Pressure plate 24 is attached to the underside of the retaining disc by means of integral captive stub 28, which is designed to be compatible with slot means positioned on the underside of the retaining disc. The slot has an elongated configuration permitting rotational movement of the retaining disc. The integral stub protrudes a short distance distance beyond the bottom of the pressure plate in order to form clamping means of the stripline cable in conjunction with center stub 34 of connector body 30, when the system is assembled.

Figure 8:
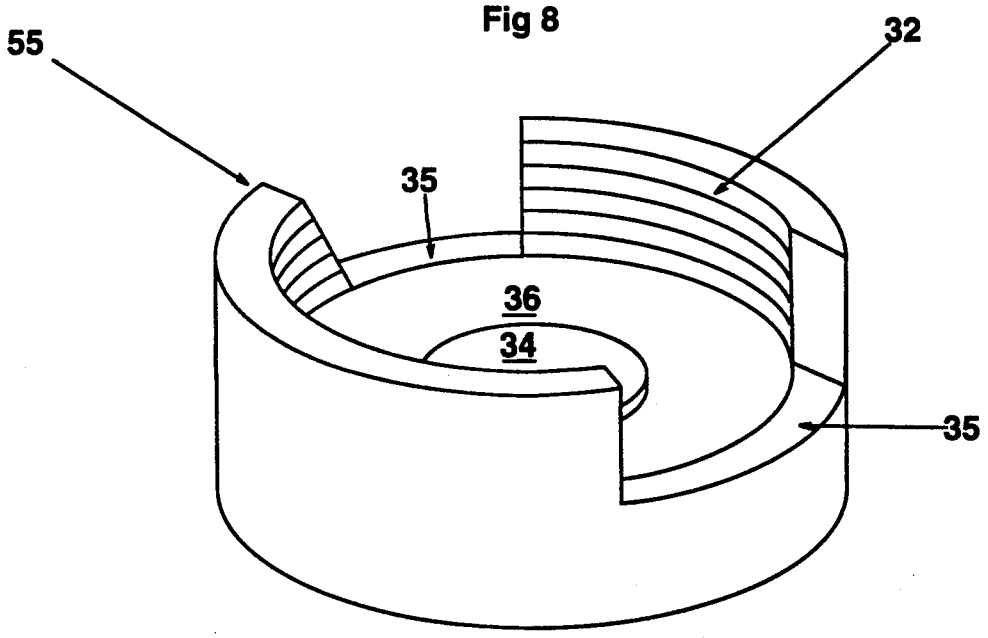
FIG. 8 is another embodiment of the present invention showing multiple cut-away segments of the connector body component designed to receive multiple stripline cables.

Connector body 30 comprises wall segment 55 and a threaded hollow interior 32 suitably contoured to receive externally threaded retaining disc 22. The body comprises a center stub 34 protruding through a bottom 36 of an insulating resin. The conductor body has a section of wall 55 removed (designated 35) in order to accommodate a stripline cable. In the alternative, multiple sections of the wall (FIG. 8) may be cut away to permit installation of cables. The interior of the connector body is suitably contoured to receive pressure plate 24 so as to restrict any rotational movement of the plate. This prevents damage to the stripline cable.

An important factor in the invention is the fabrication of the connector body and the center stub as a single unit. This results in a cavity with a protruding stub, which makes a perfect receptacle for the insulating resin. The insulating material may be any suitable material such as, for example, resins, epoxy compound, or glass if a hermetic seal is required. The choice of the insulating material may be dictated by voltage holdoff, and other systems requirements.

In the fabrication of the present invention, resin is heated to above its melting point, and poured into the connector body until the meniscus is at the top of the center stub. Any resin on the face of the center stub may be removed after curing. In the alternative, the center stub may be threaded and screwed into suitably contoured female threads extended to the bottom of the connector body.

The base of the connector body is faced off after the resin cures. The center stub is allowed to protrude about 0.01" above the surface of the insulating material. Preheating of the connector body is required to solder the interior stipline to it as the connector body acts as a large heat sink.

Although, we have described our invention with a certain degree of particularity, it is understood that various modification may be made without departing from the scope and spirit of our invention.

Having described our invention, I claim:

1. A non-shearing connector for flexible circuits comprising:

a) a solid retaining disc having a exteriorly threaded section designed to be compatible with a hollow interiorly threaded section of a connector body having a cut-away segment of wall, b) a slot milled in the bottom of the disc, c) a pressure plate attached to the retaining disc, c) captive stub means integral with the pressure plate and cooperating with the slot means, d) the slot means being of sufficient dimensions and configuration to allow the retaining disc to rotate freely, e) a center stub protruding inwardly through the bottom of the conductor body comprising an insulating resin, f) On the assembly of the connector by screwing the retaining disc into the connector body, the rotational movement of the pressure plate is restrained.

2. A device in accordance with claim 1 connected to a a stripline cable.

3. A device in accordance with claim 1, comprising multiple cut-away segments to accommodate a plurality of stripline cables.

* * * * *